US006840206B2

(12) United States Patent
Yasui

(10) Patent No.: US 6,840,206 B2
(45) Date of Patent: Jan. 11, 2005

(54) ENGINE INTAKE SYSTEM

(75) Inventor: Hisakazu Yasui, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/401,768

(22) Filed: Mar. 31, 2003

(65) Prior Publication Data

US 2003/0226536 A1 Dec. 11, 2003

(30) Foreign Application Priority Data

Jun. 7, 2002 (JP) ..... 2002-167622
Jan. 29, 2003 (JP) ..... 2003-020909

(51) Int. Cl.[7] ..... F02M 35/10
(52) U.S. Cl. ..... 123/184.53; 123/198 E
(58) Field of Search ..... 123/184.53, 198 E

(56) References Cited

U.S. PATENT DOCUMENTS 4,254,746 A * 3/1981 Chiba et al. ..... 123/184.42
5,819,696 A * 10/1998 Wada ..... 123/198 E
5,826,553 A * 10/1998 Nakayama et al. .... 123/184.42

FOREIGN PATENT DOCUMENTS

JP 2516676 Y2 8/1996

* cited by examiner

*Primary Examiner*—Tony M. Argenbright
*Assistant Examiner*—Katrina B. Harris
(74) *Attorney, Agent, or Firm*—Birch, Stewart, Kolasch & Birch, LLP

(57) ABSTRACT

An engine intake system including an air cleaner with an intake noise-damping box. The system is easily switchable from a noise-damping state to a non-noise-damping state when high output of the engine is regarded as important. The intake noise-damping box is attached to one side wall of an air cleaner. It is formed by a substantially rectangular air intake frame, the inside of which functions as an air intake open to the inside and the outside of the air cleaner. A passage former can be attached and detached to/from the air intake frame. When attached, the passage former forms an air passage extending in the longitudinal direction of the air intake frame, and communicating with the inside and the outside of the air intake frame at the air intake.

21 Claims, 12 Drawing Sheets

ENGINE INTAKE SYSTEM

CROSS-REFERENCE TO RELATED APPLICATION

The present application claims priority under 35 U.S.C. §119 to Japanese Patent Applications No. 2002-167622, filed Jun. 7, 2002, and No. 2003-020909, filed on Jan. 29, 2003, the entire contents of which are hereby incorporated by reference.

BACKGROUND OF THE INVENTION

1. Field of the Invention

The present invention relates to an intake system of an engine in which an air cleaner is connected to the upstream end of an induction system of the engine, and particularly, relates to the improvement of an intake system by reducing the intake noise of an engine in an air cleaner.

2. Description of Background Art

Heretofore, as disclosed in Japanese published patent application Ser. No. 2,516,676, it is known that the intake noise of an intake system of the engine can be reduced by forming an air intake of an air cleaner like a passage.

However, in the above-mentioned conventional type intake system, since the air intake is a passage which slightly disturbs air intake, the conventional type intake system is not suitable for an intake system of an engine for a motorcycle used for racing, in which high engine output is regarded as important, for example.

Thus, until now, when engine output is regarded as important during operation, the air cleaner is replaced with an air cleaner provided with an air intake having a large opening. However, with this conventional configuration, the work to replace the air cleaner is very troublesome.

SUMMARY AND OBJECTS OF THE INVENTION

The present invention is made in view of such a situation, and the object is to provide an intake system of an engine which can easily switch between normal operations, in which intake noise is reduced, and high output operations, in which noise reduction is not so significant a concern.

To achieve the object, a first aspect of the present invention provides an intake noise-damping box attached to one side wall of an air cleaner connected to the upstream end of an induction system of an engine. The intake noise-damping box is formed by a substantially rectangular air intake frame, the inside of which functions as an air intake open to the inside and the outside of the air cleaner and a passage former which can be detached from the air intake frame, and which forms an air passage extended in the longitudinal direction of the air intake frame when the passage former is mounted and communicating with the inside and the outside of the air intake frame at the air intake.

The induction system corresponds to a carburetor 12 and a connecting tube 15 in an embodiment of the invention described later.

According to the first aspect of the invention, in the normal operation of the engine, the passage former is mounted on the air intake frame, the relatively long air passage is formed at the air intake, and intake noise which leaks outside from the induction system can be reduced by passing intake noise caused in the air cleaner in the relatively long air passage.

On the other hand, in situations where the engine output is regarded as important, outside air is directly taken in from the air intake of the air intake frame by only detaching the passage former from the air intake frame (rather than removing the entire air cleaner, as in conventional system), resistance to air intake is reduced, and the output of the engine can be effectively enhanced.

According to a second aspect of the present invention, the passage former is formed by an outside plate extended from a first end in the longitudinal direction of the air intake frame toward a second end, and forming an air inlet between the outside plate and the second end. An inside plate curved downward from the second end adjacent to the air inlet of the air intake frame, extended toward the first end in the longitudinal direction of the air intake frame so that the inside plate is opposite to the lower surface of the outside plate in parallel, and forming an air outlet between the inside plate and the first end. In addition, a partition integrally coupling the outside plate and the inside plate between the air inlet and the air outlet and an air passage communicating with the air inlet and the air outlet is formed at the air intake by the outside plate, the inside plate and the partition.

According to the second aspect, when the passage former is mounted on the air intake frame, the air passage, the resistance of which is relatively small owing to the curvature of the inside plate though the air passage is relatively long, can be formed at the air intake. As a result, the effect of damping intake noise can be achieved, inhibiting the increase of resistance to intake possibly.

Further, according to a third aspect of the invention, the air intake frame is made of elastic material, and a surrounding groove into which the peripheral edge of the passage former is elastically fitted is formed on the inside face of the air intake frame.

According to the third aspect of the invention, the passage former can be easily attached and detached to/from the air intake frame.

Further, according to a fourth aspect of the invention, a surrounding groove, into which the margin of a cleaner case opposite to a mounting opening open to one side wall of the air cleaner is fitted, is formed on the periphery of the air intake frame. Also, a coupler elastically fitted into a coupling hole provided to the air cleaner in the circumference of the mounting opening is integrated with the outside of the air intake frame.

According to the fourth aspect, the air intake frame can be easily attached to the air cleaner and in addition, its attached state can be guaranteed by forming the coupler and the coupling hole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given below and from the accompanying drawings, which are given by way of illustration only, and thus are not limitative of the present invention, and wherein.

DETAILED DESCRIPTION OF THE PREFERRED EMBODIMENTS

Figure 1:
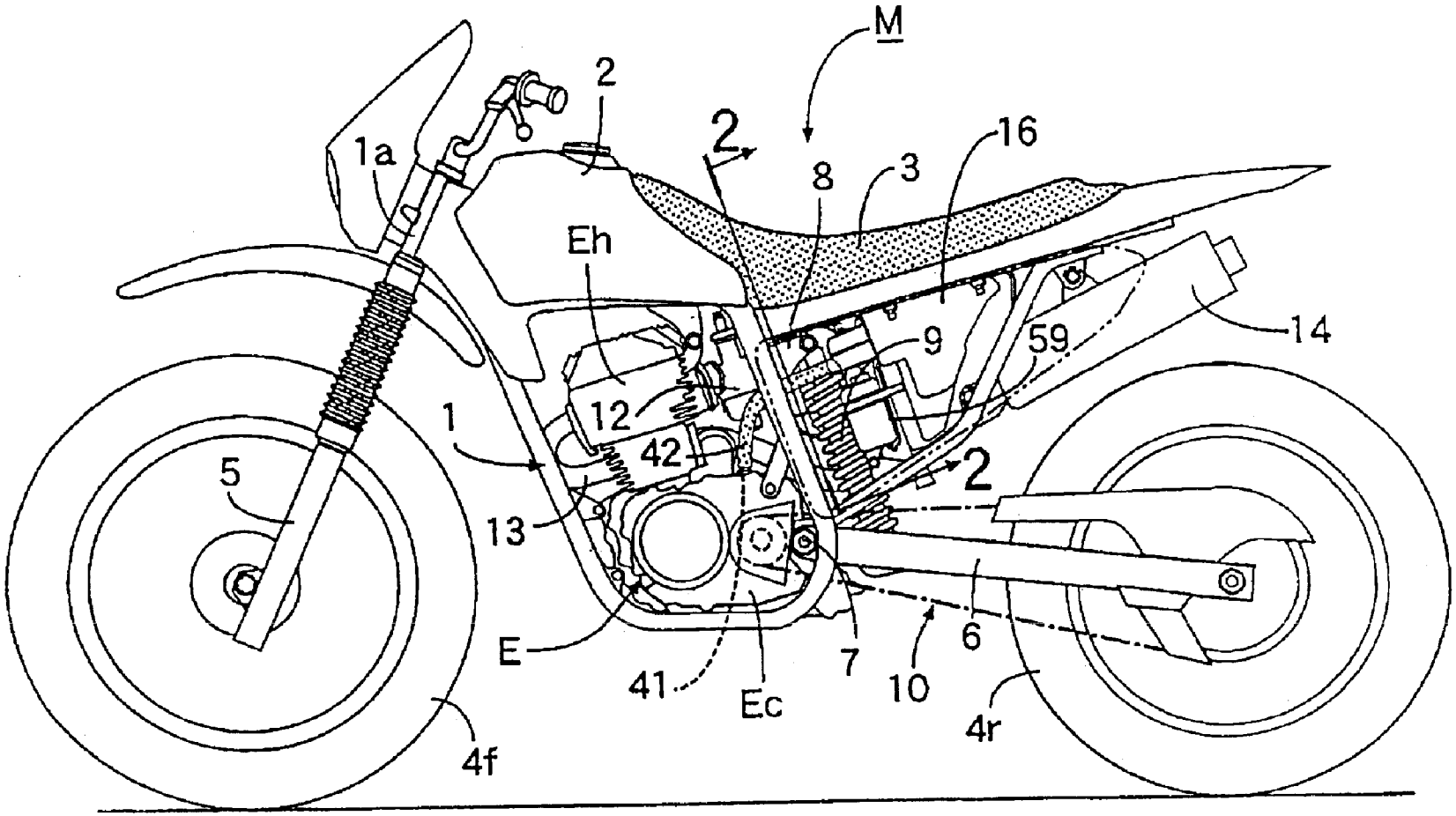
FIG. 1 is a left side view showing a motorcycle provided with a blowby gas processing system according to the invention.
Figure 2:
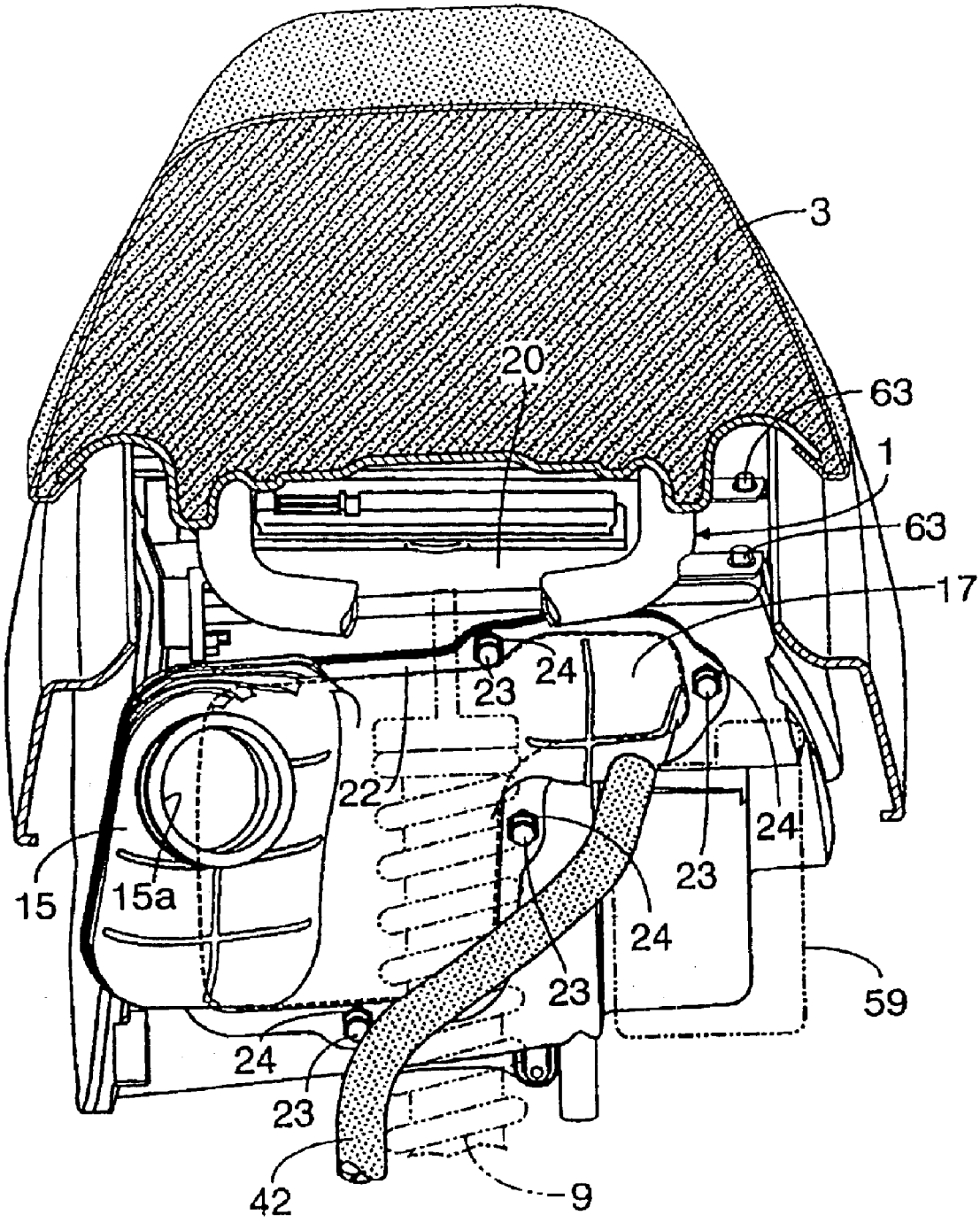
FIG. 2 is an enlarged sectional view viewed along a line 2—2 in FIG. 1.

First, as shown in FIG. 1, an engine E, a fuel tank 2 arranged on the upside of the engine E and a seat for occupants 3 ranging to the rear end of the fuel tank 2 are mounted on a body frame 1 of a motorcycle M. A front fork 5 for supporting a front wheel 4*f* is coupled to a head pipe 1*a* at the front end of the body frame 1 so that the front fork can be steered, a rear fork 6 for supporting a rear wheel 4*r* is coupled to a lower part of the center of the body frame 1 so that the rear fork can be vertically vibrated via a pivot 7 and a rear cushion 9 is attached between the rear fork 6 and a bracket 8 fixed to the upside of the body frame 1. The output of the engine B is transmitted to the rear wheel 4*r* via a chain transmission gear 10.

A carburetor 12, the intake passage of which communicates with an inside intake port, is attached to the rear face of a cylinder head Eh of the engine E, an exhaust pipe 13 which communicates with an inside exhaust port is attached to the front face of the cylinder head Eh and the exhaust pipe 13 is connected to an exhaust muffler 14 arranged on one side of the body frame 1.

As shown in FIGS. 2 to 7, an air cleaner 16 is connected to the end on the entrance side of the intake passage of the carburetor 12 via a connecting tube 15. The connecting tube 15 is made of elastic material such as rubber and a swollen part 17 the inside of which functions as a gas-liquid separating chamber 17*a* adjacent to an intake passage 15*a* in the connecting tube 15 is integrated with the upside of the upstream end.

A coupling flange 18 which also surrounds the swollen part 17 is integrated with the periphery of the upstream end of the connecting tube 15. An annular groove 19 is provided to the periphery of the coupling flange 18, the end wall of a cleaner case 20 of the air cleaner 16 is fitted into the annular groove, an element setting plate 21 is overlapped on the outer end face of the coupling flange 18 and a keep plate 22 is overlapped on the inner end face of the coupling flange 18.

Multiple bolts 23, 23,—which pierce the coupling flange 18 and the keep plate 22 are fixed to the element setting plate 21, and the coupling flange 18 and the end wall of the cleaner case 20 are held between the element setting plate 21 and the keep plate 22 by screwing nuts 24, 24,—on the bolts.

The element setting plate 21 is provided with an opening 25 corresponding to the intake passage 15*a* in the connecting tube 15, a frame trap 28 holding steel wool 26 between a pair of punched plates 27, 27' or wire nettings is installed over the opening 25 and a cleaner element 31 supported by a grid-like element holder 30 is arranged so that the cleaner element covers the frame trap 28 from the outside.

The element holder 30 is provided with a strut 30*a* holding the cleaner element 31 from the outside, piercing the center of the cleaner element 31. A pair of hinge brackets 32, 32' are provided to the element setting plate 21 with the cleaner element 31 between the hinge brackets, a presser bar 33 made of a spring member for elastically pressing the head of the strut 30*a* on the side of the element setting plate 21 is supported by one hinge bracket 32 so that the presser bar can be turned, and a fitting ring 34 to which a hook 33*a* at the end of the presser bar 33 is fitted is supported by the other hinge bracket 32'.

Therefore, when the hook 33*a* of the presser bar 33 is fitted to the fitting ring 34, the element holder 30 supporting the cleaner element 31 is fixed onto the element setting plate 21 by the spring of the presser bar 33. Conversely, when the hook 33*a* is detached from the fitting ring 34 and the presser bar 33 is detached from the strut 30*a*, it becomes possible to extract and clean the cleaner element 31.

One side in a lateral direction of the cleaner case 20 is open, and the open face is normally closed by a cover 43. When the cleaner element 31 is maintained, the cover 43 is detached and maintenance is performed from the open face of the cleaner case 20.

Figure 6:
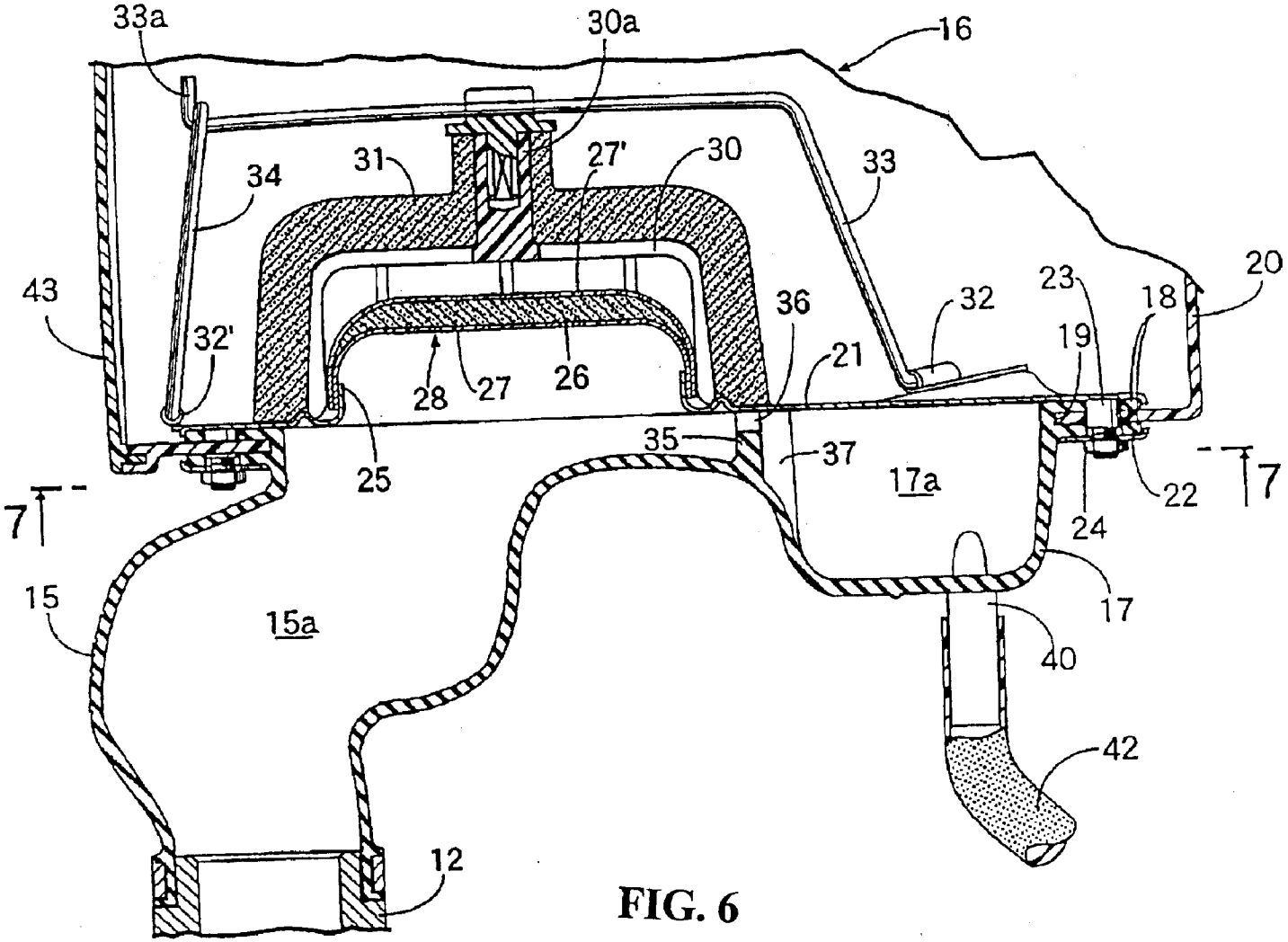
FIG. 6 is a sectional view viewed along a line 6—6 in FIG. 3.
Figure 7:
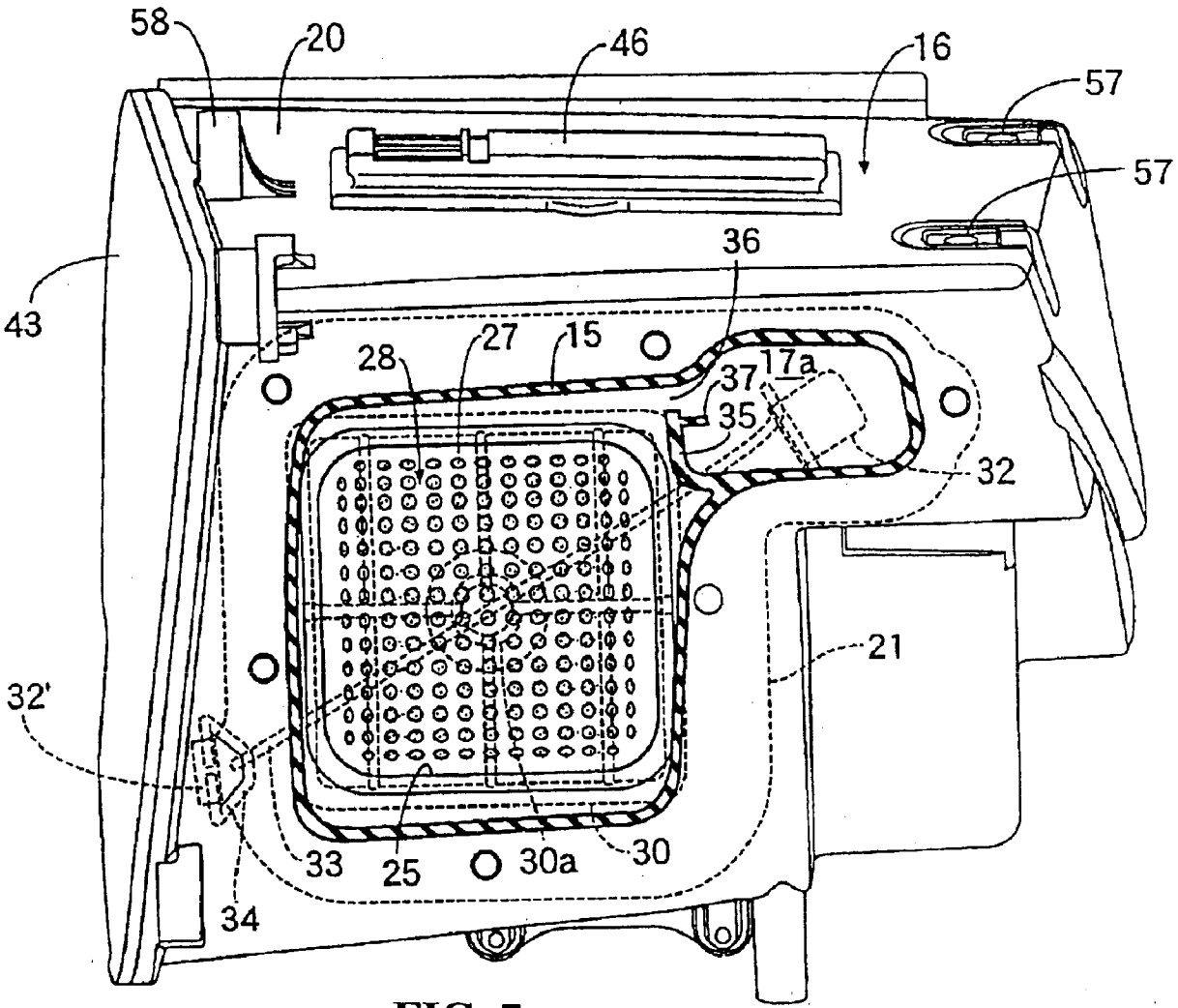
FIG. 7 is a sectional view viewed along a line 7—7 in FIG. 6.
Figure 8:
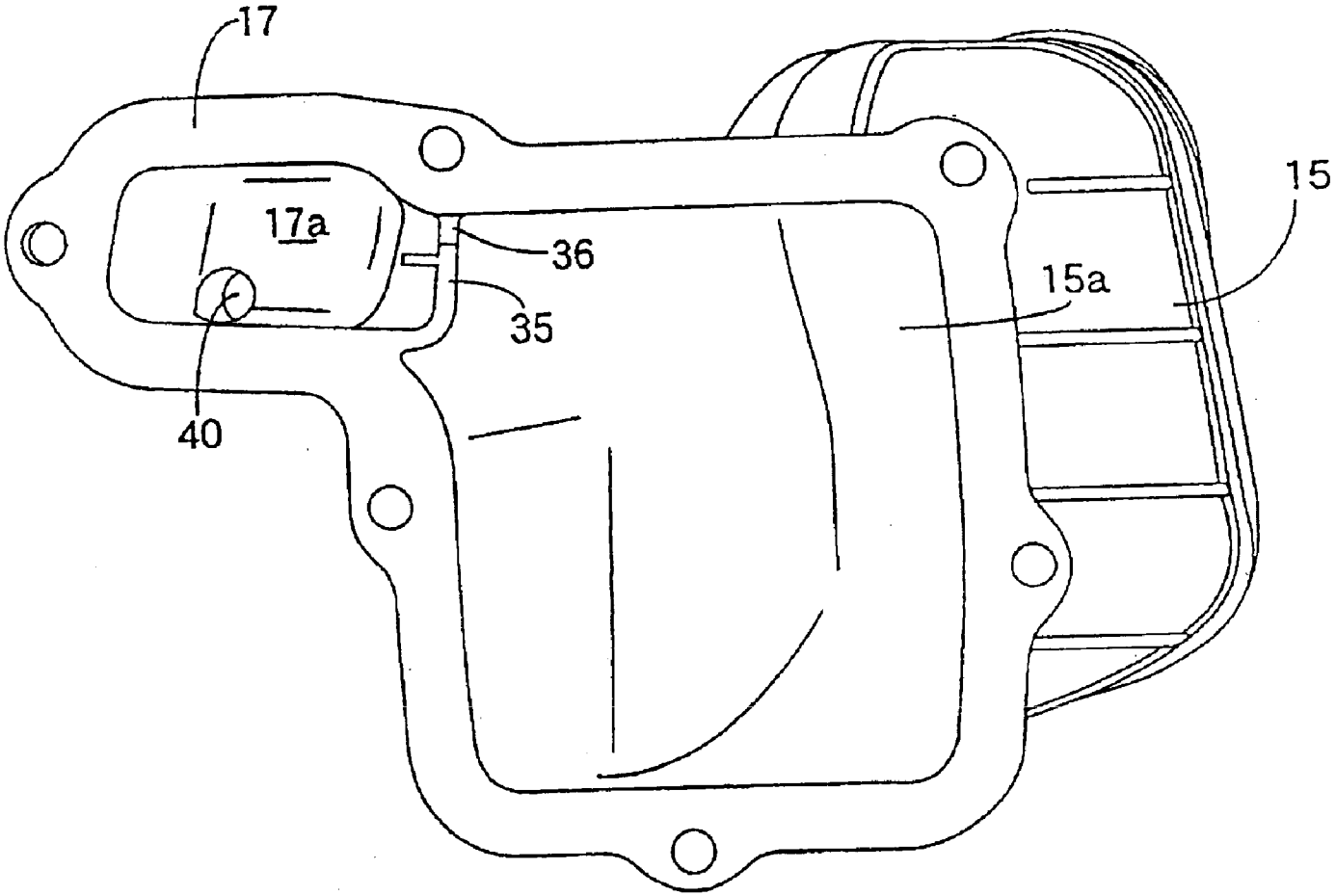
FIG. 8 is an end face view viewed from the upstream side of a connecting tube.

As shown in FIGS. 6 to 8, the gas-liquid separating chamber 17*a* is formed between the swollen part 17 and the element setting plate 21 covering the open end of the swollen part. A cut-out blowby gas exit 36 for making the upside of the gas-liquid separating chamber 17*a* communicate with the intake passage 15*a*, and an oil return wall 37 protruded on the side of the gas-liquid separating chamber 17*a*, below the blowby gas exit 36 and across the whole width in a horizontal direction of a partition 35, are formed in the partition 35 between the gas-liquid separating chamber 17*a* and the intake passage 15*a* in the connecting tube 15. An entrance joint 40 extended to a lower part of the gas-liquid separating chamber 17*a* is integrated with the swollen part 17 and a breather port 41 (see FIG. 1) open to the top face of the rear of a crankcase Ec of the engine E for exhausting blowby gas is connected to the entrance joint 40 via a breather tube 42.

Figure 9:
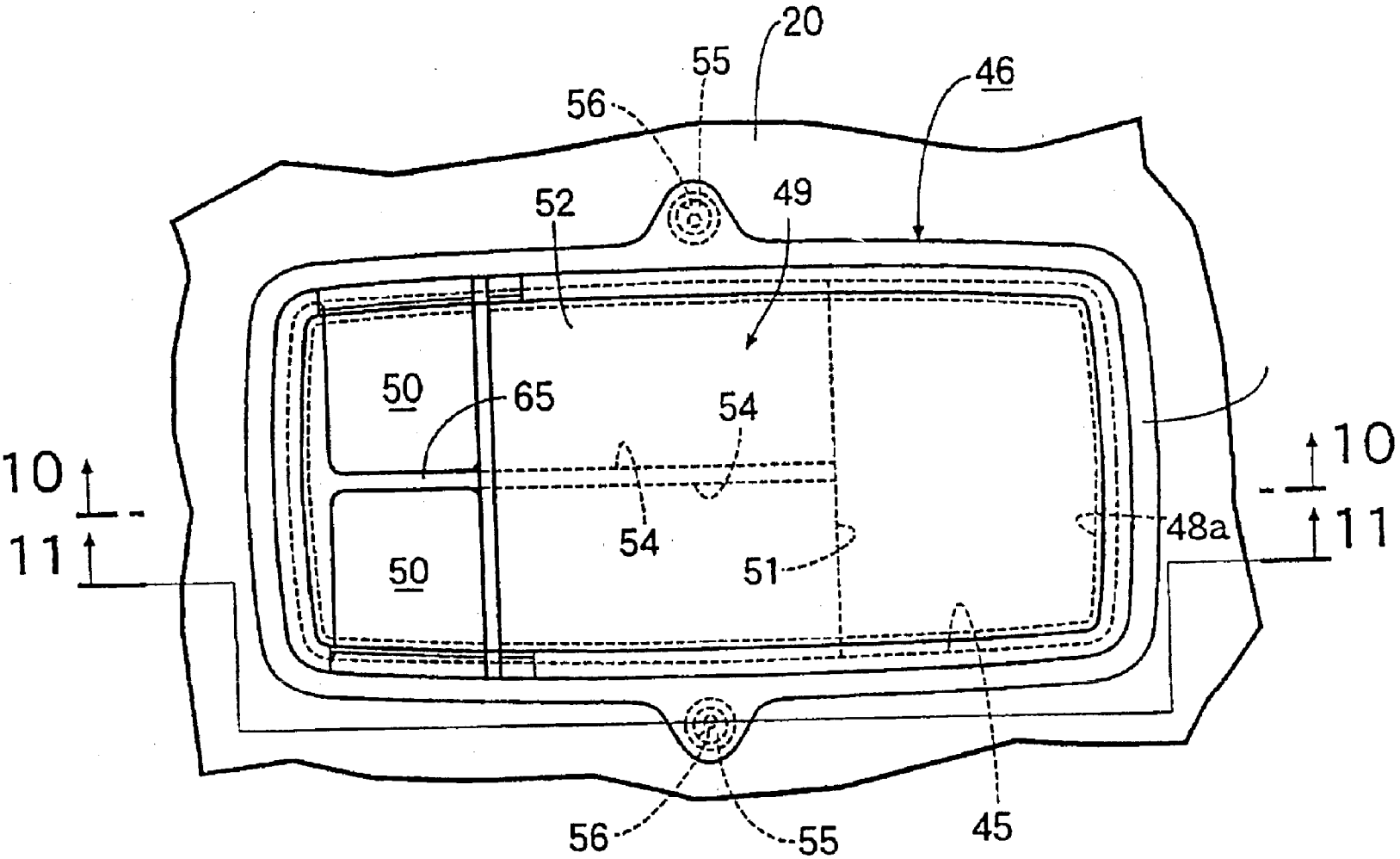
FIG. 9 is an enlarged view viewed from a direction shown by an arrow 9 in FIG. 3.
Figure 10:
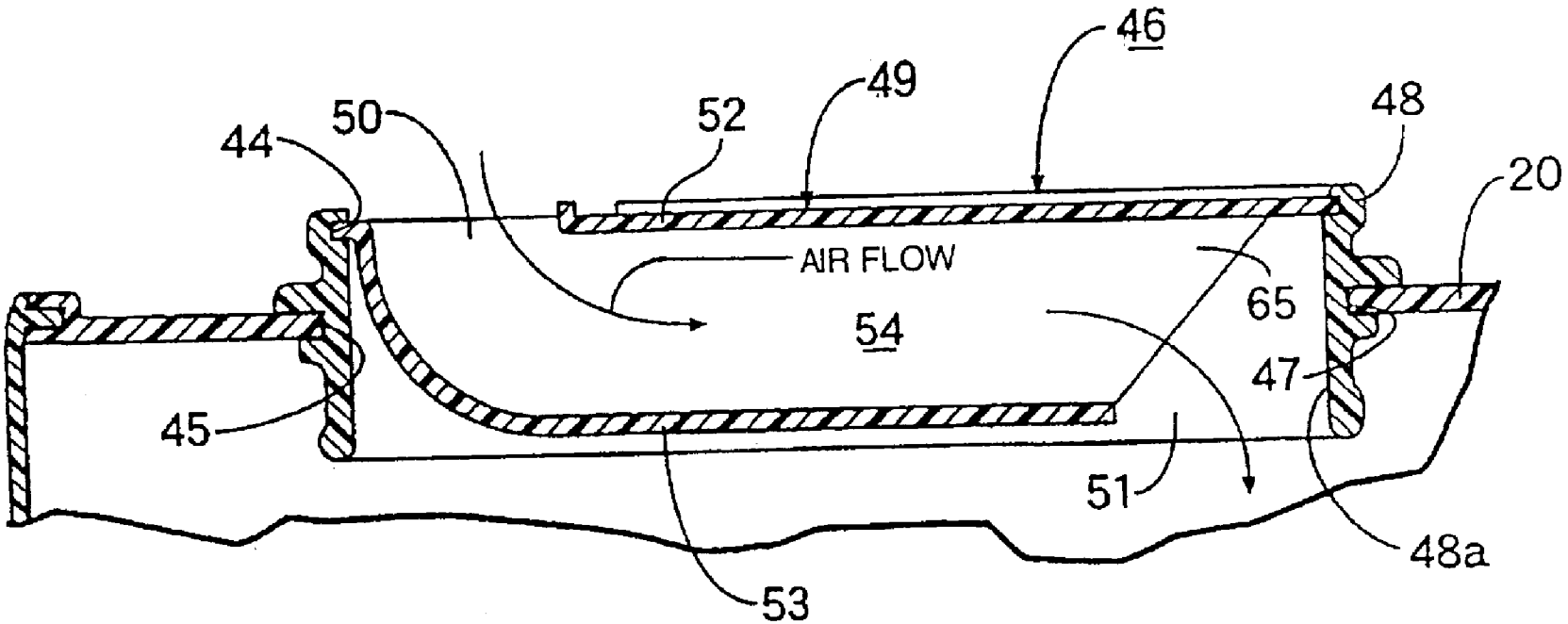
FIG. 10 is an enlarged view showing a main part of a part shown in FIG. 4.
Figure 11:
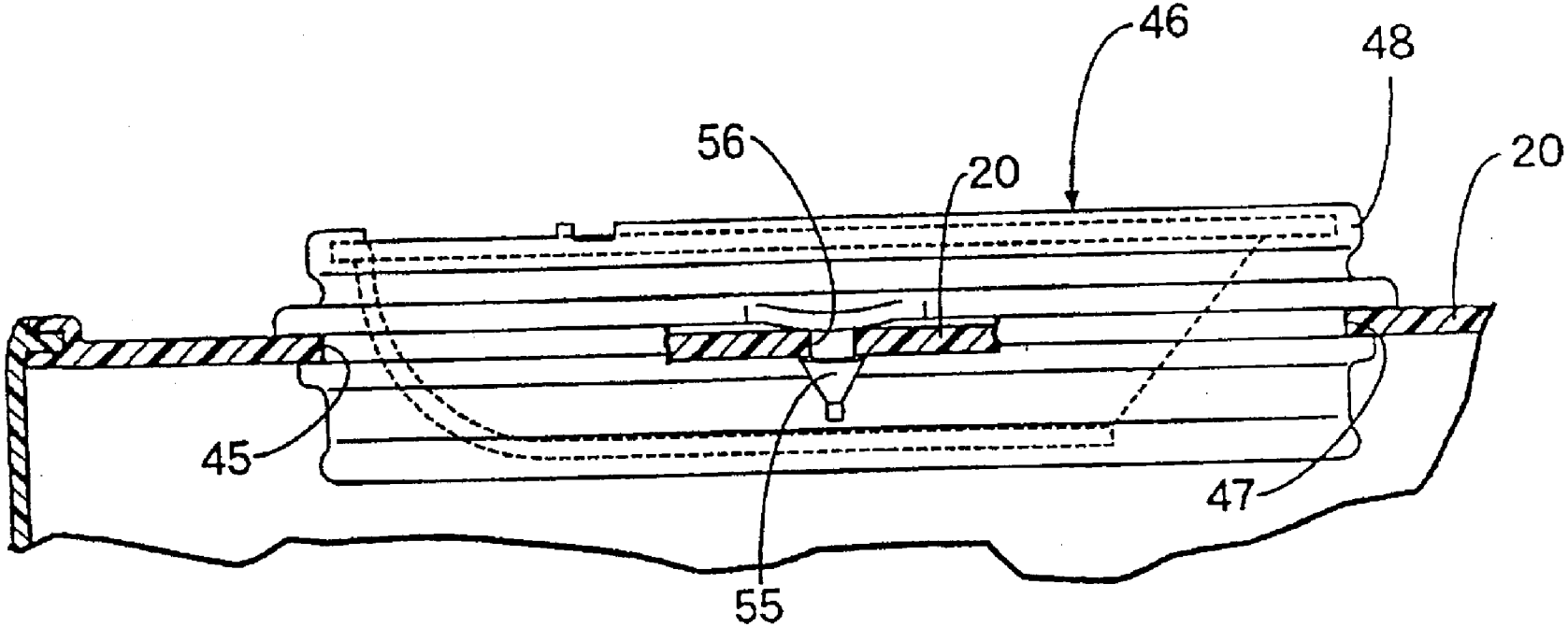
FIG. 11 is a sectional view viewed along a line II—II in FIG. 9.

As shown in FIGS. 9 to 11, a substantially rectangular mounting opening 45 is provided to the upper wall of the cleaner case 20 and an intake noise-damping box 46 is mounted there. The intake noise-damping box 46 is provided with a substantially rectangular air intake frame 48 made of rubber and having a surrounding groove 47 into the periphery of which the margin of the cleaner case opposite to the mounting opening 45 is fitted. The inside of the air intake frame 48 functions as an air intake 48*a* open to the inside and the outside of the cleaner case 20. A surrounding groove 44 is formed on the inner face of the air intake frame 48 and the peripheral edge of a passage former 49 made of synthetic resin is fitted into the groove so that the passage former can be detached. The passage former 49 is composed of an outside plate 52 extended from a first end in the longitudinal direction of the air intake frame 48 toward a second end and forming an air inlet 50 between the outside plate and the second end, an inside plate 53 curved downward from the second end adjacent to the air inlet 50 of the air intake frame 48, extended toward the first end in the longitudinal direction of the air intake frame 48 so that the inside plate is opposite to the lower surface of the outside plate 52 in parallel and forming an air outlet 51 between the inside plate and first end described above, and a partition 65 integrally coupling the respective centers of the outside plate 52 and the inside plate 53 from the air inlet 50 to the air outlet 51, and a pair of air passages 54, 54 connecting the air inlet 50 and the air outlet 51 are formed at the air intake 48*a* by the outside plate 52, the inside plate 53, and the partition 65.

Two couplers 55, 55, each having a large head, are integrated with the outside of the air intake frame 48. Attachment of the air intake frame 48 to the cleaner case 20 is assured by elastically fitting the couplers 55, 55 into a pair of coupling holes 56, 56 made on the ceiling wall of the cleaner case 20.

Figure 3:
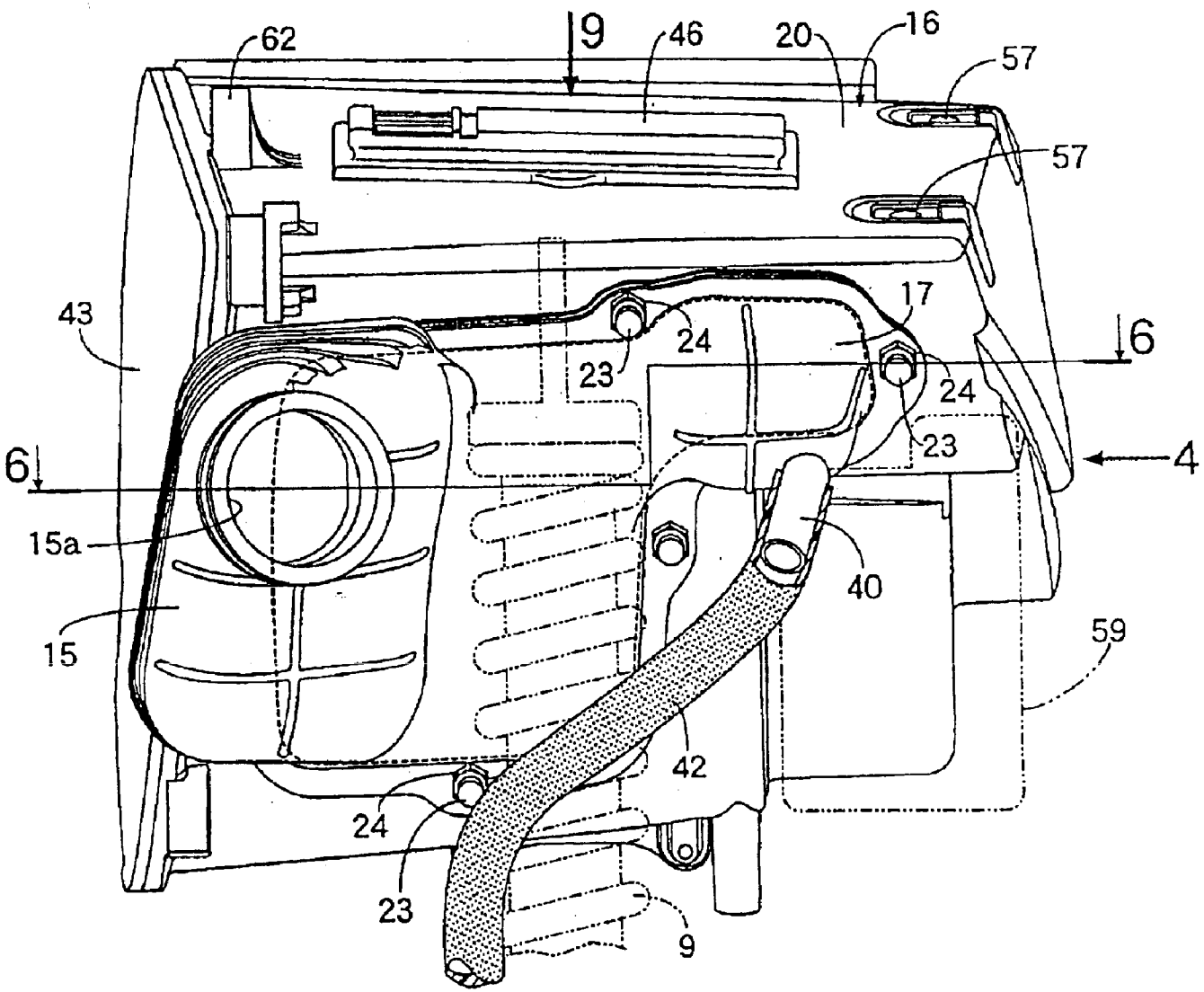
FIG. 3 is an enlarged view showing a main part of a part shown in FIG. 2.
Figure 5:
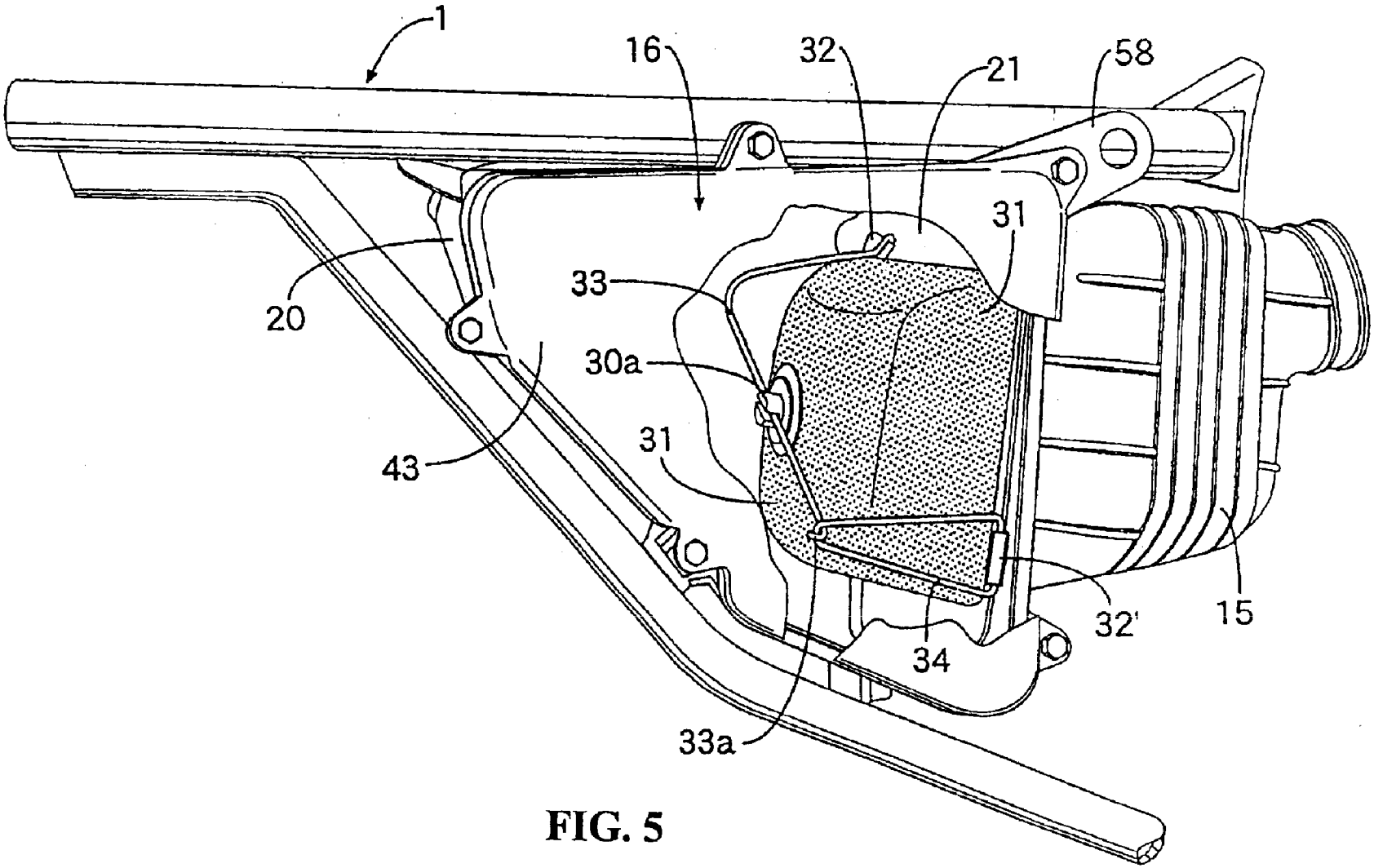
FIG. 5 is a side view showing a periphery of an air cleaner viewed from the side reverse to the side shown in FIG. 1.

Again as shown in FIGS. 3 and 5, a pair of front and rear nuts 57, 57 are attached on one side in a lateral direction of the top face of the cleaner case 20. One ear piece 58 is integrated with the top face of the cleaner case on the other side, one side of the cleaner case 20 is fixed to one side of the body frame 1 by bolts 63, 63 (see FIG. 2) screwed to the nuts 57, 57 and the ear piece 58 is connected to the other sides of the right and left body frames 1 by a bolt. As a result, the air cleaner 16 is supported by the body frame 1.

Figure 4:
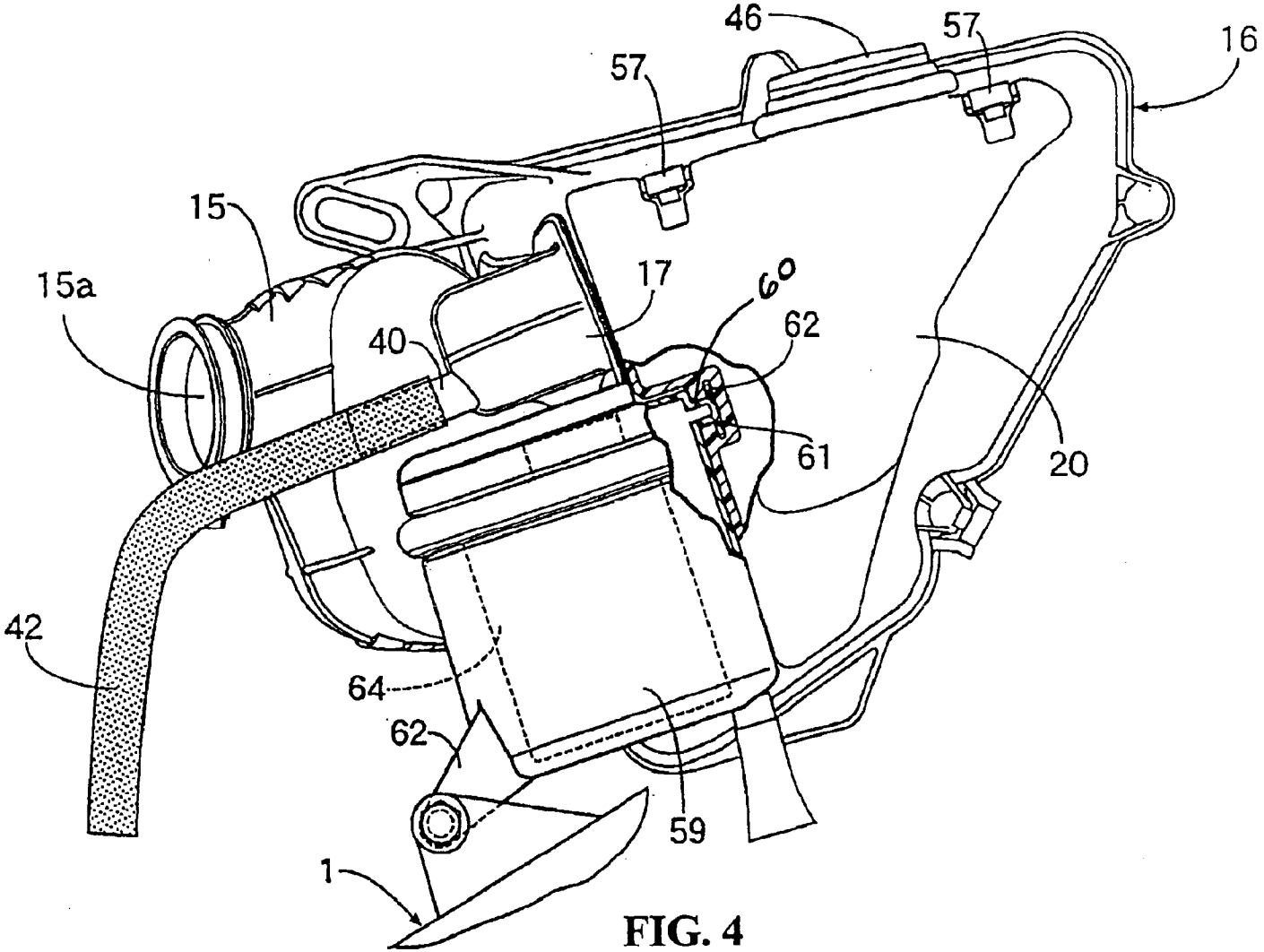
FIG. 4 is a view viewed from a direction shown by an arrow 4 in FIG. 3.

As shown in FIGS. 3 and 4, the swollen part 17 forming the gas-liquid separating chamber 17*a* is integrated with the upside of the upstream end of the connecting tube 15, as described above. A battery box 59 made of synthetic resin for housing a battery 64 is coupled to the cleaner case 20 immediately under the swollen part 17 and on one side of the connecting tube 15.

A coupling projection 60 the cross section of which is T type is integrated with the back opposite to the cleaner case 20 of the battery box 59, and is fitted to a coupling groove 61 the cross section of which is T type and which is provided to the front of the cleaner case 20. A bracket 62 is integrated with the front of the battery box 59 and is connected to the body frame 1 by a bolt. As a result, the battery box 59 is supported by the body frame 1 and the cleaner case 20.

As a result, dead space immediately under the swollen part 17 and on one side of the connecting tube 15 is utilized for space for installing the battery box 59, the periphery of the engine E is compacted, and the supporting structure of the battery box 59 is simplified.

As shown in FIGS. 1 and 3, the rear cushion 6 is arranged utilizing the dead space between the connecting tube 15 and the swollen part 17.

Next, the action of this embodiment will be described.

When the motorcycle M is used normally, the passage former 49 is mounted on the air intake frame 48 as shown in FIGS. 9 to 12. Therefore, in an intake stroke of the engine E, after outside air passes a pair of air passages 54, 54 through the air inlet 50 separately flowing, it flows into the cleaner case 20 via the common air outlet 51. The outside air then is filtered by the cleaner element 31, passes the frame trap 28, further passes the connecting tube 15 and the carburetor 12, and is inhaled into the engine E, being mixed with jetted fuel in the carburetor 12.

Meanwhile, since intake noise caused in the air cleaner 16 is damped through a pair of air passages 54, 54 extended in the longitudinal direction of the relatively long air intake frame 48, noise leaking outside from an induction system can be reduced.

In addition, in the air passages 54, 54, the flow of intake air smooths owing the curve at the air inlet 50 of the inside plate 53, and the increase of resistance to intake air can be inhibited. Intake air is rectified by providing multiple air passages 54, and thus, the resistance to intake air can be further reduced. Since the intake noise-damping box having the multiple air passages 54, 54 is composed of two members of the air intake frame 48, and the passage former 49 is composed of the outside plate 52, the inside plate 53 and the partition 65, the configuration is simple and can be provided at a low price.

Figure 12:
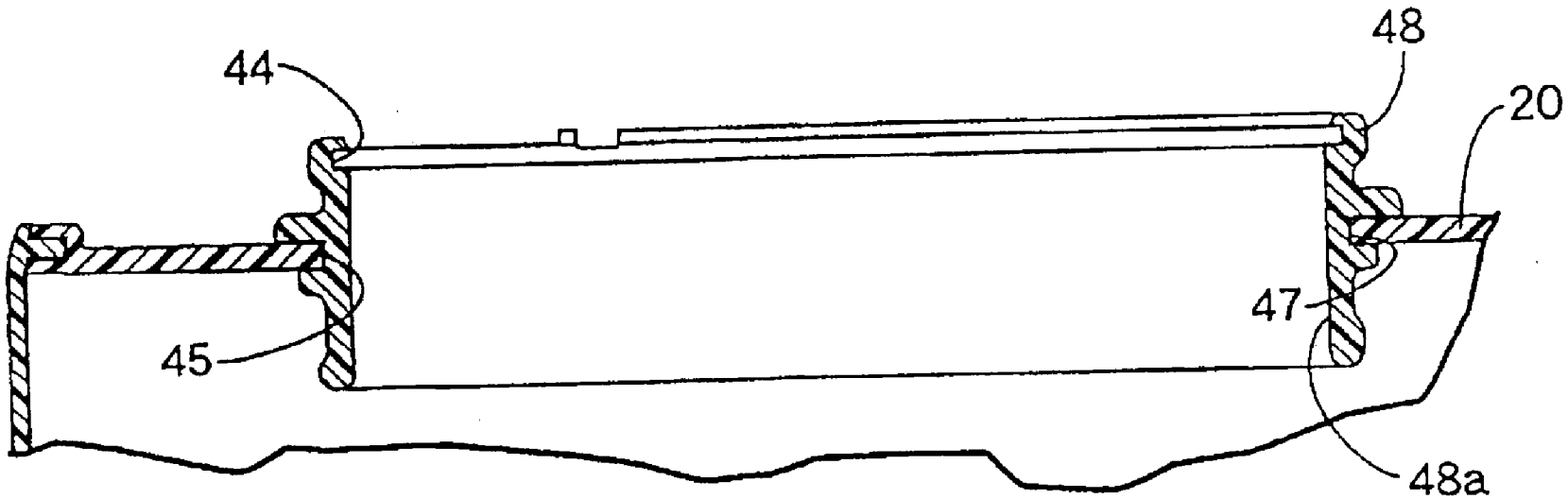
FIG. 12 shows a state in which a passage former is detached from an air intake frame and corresponds to FIG. 10.

On the other hand, in the case of a motorcycle M used for racing at high speeds in which high output of the engine E is important, as shown in FIG. 12, the passage former 49 can be easily detached from the air intake frame 48. As a result, outside air is directly taken in from the air intake 48*a*, the length of which is short and which has an opening of large area inside the air intake frame 48. Thus, resistance to intake air is reduced and the output of the engine can be enhanced.

While the engine E is driven, blowby gas caused in the crankcase Ec flows into the gas-liquid separating chamber 17*a* from the breather port 41 via the breather tube 42. When the blowby gas is expanded, it is separated into gas and liquid, separated oil again flows in the breather tube 42 downward and is returned into the crankcase Ec from the breather port 41. Then, the blowby gas from which oil is separated is sent into the intake passage 15*a* in the connecting tube 15 via the blowby gas exit 36, is inhaled into the engine E, being mixed with inhaled air passing the intake passage 15*a*, and there, a combustion process is executed.

Even if oil separated from blowby gas in the gas-liquid separating chamber 17*a* should rise along an inner wall on the side of the blowby gas exit 36 of the gas-liquid separating chamber 17*a* by the action of manifold air pressure, the oil can be prevented from entering the blowby gas exit 36 because the rise of the oil is prevented by the oil return wall 37 before the blowby gas exit 36.

Since the swollen part 17 functioning as the gas-liquid separating chamber 17*a* is integrated with the connecting tube 15, an oil separator tank is not required to be specially provided on the way of the breather tube 42. Thus, means for supporting the tank is not required, the configuration can be simplified, and the cost can be reduced.

In the present invention, the gas-liquid separating chamber 17*a* is formed between the swollen part 17 integrated with one side of the upstream end of the connecting tube 15 and the element setting plate 21 covering the open end and the cut-out blowby gas exit 36 is formed in the partition 35 between the gas-liquid separating chamber 17*a* and the intake passage 15*a* in the connecting tube 15. Thus, the element setting plate 21 joins the configuration of the gas-liquid separating chamber 17*a*, facilitates the formation of the gas-liquid separating chamber 17*a*, the number of parts is prevented from being increasing and the cost can be more reduced.

The invention is not limited to the embodiment and various design changes without deviating from the scope are allowed. For example, in the passage former 49 of the intake noise-damping box 46, plural partitions 65 are arranged in parallel and more than two air passages 54 may be also formed. Or one air passage 54 is formed and a pair of partitions 65 may be also arranged at both side ends of the passage former 49.

The effects of the invention are summarized next.

As described above, according to the first aspect of the invention, the intake noise-damping box is attached to one side wall of the air cleaner connected to the upstream end of the induction system of the engine and is formed by the substantially rectangular air intake frame the inside of which functions as the air intake open to the inside and the outside of the air cleaner. The passage former is detachable from the air intake frame and forms the air passage extended in the longitudinal direction of the air intake frame when the passage former is mounted and communicates with the inside and the outside of the air intake frame at the air intake.

Since the passage former is mounted on the air intake frame during normal engine operations, the relatively long air passage is formed at the air intake, and intake noise which leaks outside from the induction system can be reduced by passing intake noise caused in the air cleaner in the relatively long air passage. On the other hand, during higher speed operations, such as racing, where high engine output is important, outside air can be taken in directly via the air intake of the air intake frame by simply detaching the passage former from the air intake frame. In this situation, resistance to intake can be reduced and the output of the engine can be effectively enhanced.

According to the second aspect of the invention, the passage former is formed by the outside plate extended from a first end in the longitudinal direction of the air intake frame toward a second end and forming the air inlet between the outside plate and the second end. The inside plate is curved downward from the second end adjacent to the air inlet of the air intake frame, and extended toward first end in the longitudinal direction of the air intake frame so that the inside plate is opposite to the lower surface of the outside plate in parallel and forming the air outlet between the inside plate and the first end. The partition integrally couples the outside plate and the inside plate between the air inlet and the air outlet and the air passage communicating with the air inlet. The air outlet is formed at the air intake by the outside plate, the inside plate and the partition. Thus, a relatively long air passage, in which resistance is relatively small owing to the curvature of the inside plate though the air passage, can be formed at the air intake when the passage former is mounted on the air intake frame.

As a result, a positive effect for damping intake noise is achieved.

Further, according to the third aspect of the invention, since the air intake frame is made of elastic material, and the surrounding groove into which the peripheral edge of the passage former is elastically fitted is formed on the inner face of the air intake frame, the passage former can be easily attached and detached to/from the air intake frame.

Further, according to the fourth aspect of the invention, the surrounding groove, into which the margin of the cleaner case opposite to the mounting opening open to one side wall of the air cleaner is fitted, is formed on the periphery of the air intake frame. In addition, the coupler elastically fitted into the coupling hole provided to the air cleaner in the circumference of the mounting opening is integrated with the outside of the air intake frame. Thus, the air intake frame can be easily attached to the air cleaner. Moreover, the attached state can be assured by the formation of the coupler and the coupling hole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake system of an engine, comprising:

an intake noise-damping box detachably mounted on an upper wall of an air cleaner connected to an upstream end of an induction system of an engine, wherein the intake noise-damping box includes:

a substantially rectangular air intake frame, an inside of which functions as an air intake open to an inside and an outside of the air cleaner; and a passage former which can be detached from the air intake frame and which forms an air passage extending in a longitudinal direction of the air intake frame when the passage former is mounted and communicating with the inside and the outside of the air intake frame at the air intake.

2. The intake system of an engine according to claim 1, the passage former comprising:

an outside plate extending from a first end in a longitudinal direction of the air intake frame toward a second end, and forming an air inlet between the outside plate and said second end;

an inside plate curved downward from said second end adjacent to the air inlet of the air intake frame, extending toward said first end in the longitudinal direction of the air intake frame so that the inside plate is opposite and parallel to a lower surface of the outside plate and forming an air outlet between the inside plate and said first end; and a partition integrally coupling the outside plate and the inside plate and extending from the air inlet to the air outlet, wherein an air passage connecting the air inlet and the air outlet is formed at the air intake by the outside plate, the inside plate and the partition.

3. The intake system of an engine according to claim 1, wherein:

the air intake frame is made of elastic material; and a first surrounding groove is formed on an inside face of the air intake frame, a peripheral edge of the passage former being elastically fitted into said first surrounding groove.

4. The intake system of an engine according to claim 3, wherein:

a case of the air cleaner is provided with an margin opening open to said side wall of the air cleaner, and a second surrounding groove is formed on an outside periphery of the air intake frame, the margin opening of the case being fitted into said second surrounding groove of the air intake frame, and a coupler is integrated with the outside periphery of the air intake frame, the coupler being fitted into a coupling hole provided to the air cleaner in the circumference of the mounting opening.

5. The intake system of an engine according to claim 4, wherein two couplers are integrated on opposite longitudinal sides of an outside periphery of the air intake frame, the air passage of the intake noise-damping box extending between the two couplers.

6. The intake system of an engine according to claim 2, wherein a plurality of the partitions are provided, the partitions being arranged in parallel, and a plurality of the air passages are formed.

7. The intake system of an engine according claim 3, wherein the passage former is easily removable from the first surrounding groove of the air intake frame.

8. An intake system of an engine, comprising:

an intake noise-damping box detachably mounted on an upper side wall of an air cleaner connected to an upstream end of an induction system of an engine, wherein the intake noise-damping box includes:

a substantially rectangular air intake frame, an inside of which functions as an air intake open to an inside and an outside of the air cleaner; and a passage former which can be detached from the air intake frame and which forms an air passage extending in a longitudinal direction of the air intake frame when the passage former is mounted and communicating with the inside and the outside of the air intake frame at the air intake.

9. The intake system of an engine according to claim 8, the passage former comprising:

an outside plate extending from a first end in a longitudinal direction of the air intake frame toward a second end, and forming an air inlet between the outside plate and said second end;

an inside plate curved downward from said second end adjacent to the air inlet of the air intake frame, extending toward said first end in the longitudinal direction of the air intake frame so that the inside plate is opposite and parallel to a lower surface of the outside plate and forming an air outlet between the inside plate and said first end; and a partition integrally coupling the outside plate and the inside plate and extending from the air inlet to the air outlet, wherein an air passage connecting the air inlet and the air outlet is formed at the air intake by the outside plate, the inside plate and the partition.

10. The intake system of an engine according to claim 8, wherein:

the air intake frame is made of elastic material; and a first surrounding groove is formed on an inside face of the air intake frame, a peripheral edge of the passage former being elastically fitted into said first surrounding groove.

11. The intake system of an engine according to claim 10, wherein:

a case of the air cleaner is provided with an margin opening open to said upper side wall of the air cleaner, and a second surrounding groove is formed on an outside periphery of the air intake frame, the margin opening of the case being fitted into said second surrounding groove of the air intake frame, and a coupler is integrated with the outside periphery of the air intake frame, the coupler being fitted into a coupling hole provided to the air cleaner in the circumference of the mounting opening.

12. The intake system of an engine according to claim 11, wherein two couplers are integrated on opposite longitudinal sides of an outside periphery of the air intake frame, the air passage of the intake noise-damping box extending between the two couplers.

13. The intake system of an engine according to claim 9, wherein a plurality of the partitions are provided, the partitions being arranged in parallel, and a plurality of the air passages are formed.

14. The intake system of an engine according claim 11, wherein the passage former is easily removable from the first surrounding groove of the air intake frame.

15. An intake system of an engine, comprising:

an air cleaner with a case, the air cleaner being connected to an upstream end of an induction system of an engine; and an intake noise-damping box attached to an upper side of the case, wherein the intake noise-damping box includes:

a substantially rectangular air intake frame, an inside of which functions as an air intake open to an inside and an outside of the air cleaner; and a passage former which can be detached from the air intake frame and which forms an air passage extending in a longitudinal direction of the air intake frame when the passage former is mounted and communicating with the inside and the outside of the air intake frame at the air intake, wherein an upper portion of the intake damper box extends higher than the upper side of the case, and an air inlet is formed on a top face of the damper box.

16. The intake system of an engine according to claim 15, the passage former comprising:

an outside plate extending from a first end in a longitudinal direction of the air intake frame toward a second end, and forming the air inlet between the outside plate and said second end;

an inside plate curved downward from said second end adjacent to the air inlet of the air intake frame, extending toward said first end in the longitudinal direction of the air intake frame so that the inside plate is opposite and parallel to a lower surface of the outside plate and forming an air outlet between the inside plate and said first end; and a partition integrally coupling the outside plate and the inside plate and extending from the air inlet to the air outlet, wherein an air passage connecting the air inlet and the air outlet is formed at the air intake by the outside plate, the inside plate and the partition.

17. The intake system of an engine according to claim 15 wherein:

the air intake frame is made of elastic material; and a first surrounding groove is formed on an inside face of the air intake frame, a peripheral edge of the passage former being elastically fitted into said first surrounding groove.

18. The intake system of an engine according to claim 17, wherein:

the case of the air cleaner is provided with an margin opening open to said side wall of the air cleaner, and a second surrounding groove is formed on an outside periphery of the air intake frame, the margin opening of the case being fitted into said second surrounding groove of the air intake frame, and a coupler is integrated with the outside periphery of the air intake frame, the coupler being fitted into a coupling hole provided to the air cleaner in the circumference of the mounting opening.

19. The intake system of an engine according to claim 18, wherein two couplers are integrated on opposite longitudinal sides of an outside periphery of the air intake frame, the air passage of the intake noise-damping box extending between the two couplers.

20. The intake system of an engine according to claim 16, wherein a plurality of the partitions are provided, the partitions being arranged in parallel, and a plurality of the air passages are formed.

21. An intake system of an engine, comprising:

an intake noise-damping box attached to a side wall of an air cleaner connected to an upstream end of an induction system of an engine, wherein the intake noise-damping box includes:

a substantially rectangular air intake frame, an inside of which functions as an air intake open to an inside and an outside of the air cleaner; and a passage former for damping an intake noise, the passage former being detachable from the air intake frame and forming an air passage extending in a longitudinal direction of the air intake frame when the passage former is mounted and communicating with the inside and the outside of the air intake frame at the air intake.

* * * * *